US008259892B2

(12) United States Patent
Gauthier et al.

(10) Patent No.: US 8,259,892 B2
(45) Date of Patent: Sep. 4, 2012

(54) TRANSPORT CONTAINER FOR NUCLEAR FUEL ASSEMBLIES AND USE OF SAID CONTAINER

(75) Inventors: Jacques Gauthier, Cailloux sur Fontaines (FR); Pierre Wegeler, Villieu (FR); Serge Roillet, Lyons (FR)

(73) Assignee: Areva NP, Courbevoie (FR)

( * ) Notice: Subject to any disclaimer, the term of this patent is extended or adjusted under 35 U.S.C. 154(b) by 461 days.

(21) Appl. No.: 12/310,295

(22) PCT Filed: Jun. 21, 2007

(86) PCT No.: PCT/FR2007/001032

§ 371 (c)(1),
(2), (4) Date: Feb. 20, 2009

(87) PCT Pub. No.: WO2008/023101

PCT Pub. Date: Feb. 28, 2008

(65) Prior Publication Data

US 2010/0014623 A1 Jan. 21, 2010

(30) Foreign Application Priority Data

Aug. 21, 2006 (FR) ..... 06 07424

(51) Int. Cl.
*G21C 19/00* (2006.01)

(52) U.S. Cl. ..... 376/272; 376/261; 250/507.1; 250/494.1

(58) Field of Classification Search ..... 376/272, 376/261; 250/507.1, 494.1
See application file for complete search history.

(56) References Cited

U.S. PATENT DOCUMENTS

| | | | | |
|---|---|---|---|---|
| 3,575,601 | A * | 4/1971 | Lindsay et al. | 250/494.1 |
| 5,061,858 | A * | 10/1991 | Mallory | 250/507.1 |
| 5,263,064 | A * | 11/1993 | Sappey | 376/261 |
| 6,580,085 | B1 * | 6/2003 | Gaucherand | 250/507.1 |
| 6,683,931 | B1 * | 1/2004 | Stilwell et al. | 376/272 |
| 6,748,042 | B1 * | 6/2004 | Stilwell et al. | 376/272 |
| 6,802,671 | B1 * | 10/2004 | Badie et al. | 405/129.55 |

FOREIGN PATENT DOCUMENTS

| | | |
|---|---|---|
| EP | 0 506 512 A1 | 9/1992 |
| JP | 60 147699 | 8/1985 |
| JP | 08 062389 | 3/1996 |
| WO | WO 99/41754 | 8/1999 |

* cited by examiner

*Primary Examiner* — Ricardo Palabrica
(74) *Attorney, Agent, or Firm* — Davidson, Davidson & Kappel, LLC

(57) ABSTRACT

A container including a support having at least one first longitudinal support surface defining a longitudinal housing for receiving a nuclear fuel assembly, and a door having a second longitudinal support surface. The door is movable between a position of holding the nuclear fuel assembly between the two longitudinal surfaces and a released position in which the assembly is free with respect to the support. The container includes means for adjusting the transversal separation between the first and second surfaces in the holding position of the door.

20 Claims, 5 Drawing Sheets

TRANSPORT CONTAINER FOR NUCLEAR FUEL ASSEMBLIES AND USE OF SAID CONTAINER

Priority is claimed to French Application Serial No. FR 06 07424 filed Aug. 21, 2006 through International Patent Application Serial No. PCT/FR2007/001032, filed Jun. 21, 2007.

The invention relates in general to transport containers for nuclear fuel assemblies.

To be more precise, the invention relates, according to a first aspect, to a transport container for nuclear fuel assemblies of elongate shape in a longitudinal direction, of the type comprising a support having at least a first longitudinal bearing surface delimiting a longitudinal housing for receiving a nuclear fuel assembly, and a door having a second longitudinal bearing surface, the door being movable between a position holding the nuclear fuel assembly between the two longitudinal surfaces and a release position in which the assembly is free with respect to the support.

BACKGROUND

The document WO-99/41754 describes such a container. In this container, the second longitudinal surface rests on a nuclear fuel assembly located in the housing by means of bearing runners mounted movably on the door. These runners are distributed longitudinally so that they each rest on a grid of the skeleton of the nuclear fuel assembly. Since each type of assembly has a specific cross-section and specific grid positions, it is necessary to use a specific door for each type of assembly, which is complicated and expensive.

SUMMARY OF THE INVENTION

In this context, an object of the invention is to provide a container which is suitable for transporting several types of assembly and which is more readily adaptable to each of them.

To that end, the invention relates to a transport container of the above-mentioned type, characterized in that it comprises means for adjusting the spacing between the first and second surfaces in the holding position of the door.

The container may also have one or more of the following features, considered individually or in accordance with any technically possible combination:

- the first surface comprises a first pair of longitudinal faces arranged in the shape of a V, and the second surface comprises a second pair of longitudinal faces which are arranged in the shape of a V and which are parallel with and opposite the faces of the first pair when the door is in the holding position;
- the first and second pairs of faces in a V shape converge towards first and second vertices, respectively, the adjusting means comprising means for adjusting the position of the door with respect to the support by translation of the door in a transverse adjusting direction passing via the first and second vertices when the door is in the holding position;
- the support comprises parallel longitudinal surfaces for guiding the translation of the door in the direction of adjustment;
- the container comprises means for displacing the door with respect to the support between its holding and release positions by translation in the direction of adjustment and then rotation about at least one longitudinal shaft;

- the faces of the first pair form between them an angle substantially equal to that which the faces of the second pair form between them, this angle being from 60° to 135°;
- the second longitudinal bearing surface is free from movable runners for resting on a nuclear fuel assembly; and
- the second longitudinal bearing surface is suitable for resting directly on a nuclear fuel assembly.

According to a second aspect, the invention relates to the use of a container as defined above for transporting a nuclear fuel assembly.

According to one variant, the container is used with the same support and the same door to transport nuclear fuel assemblies of at least two different types.

BRIEF DESCRIPTION OF THE DRAWINGS

Other features and advantages of the invention will emerge from the description thereof which is given hereinafter, by way of example which is in no way limiting, with reference to the appended Figures, in which.

DETAILED DESCRIPTION

Figure 1:
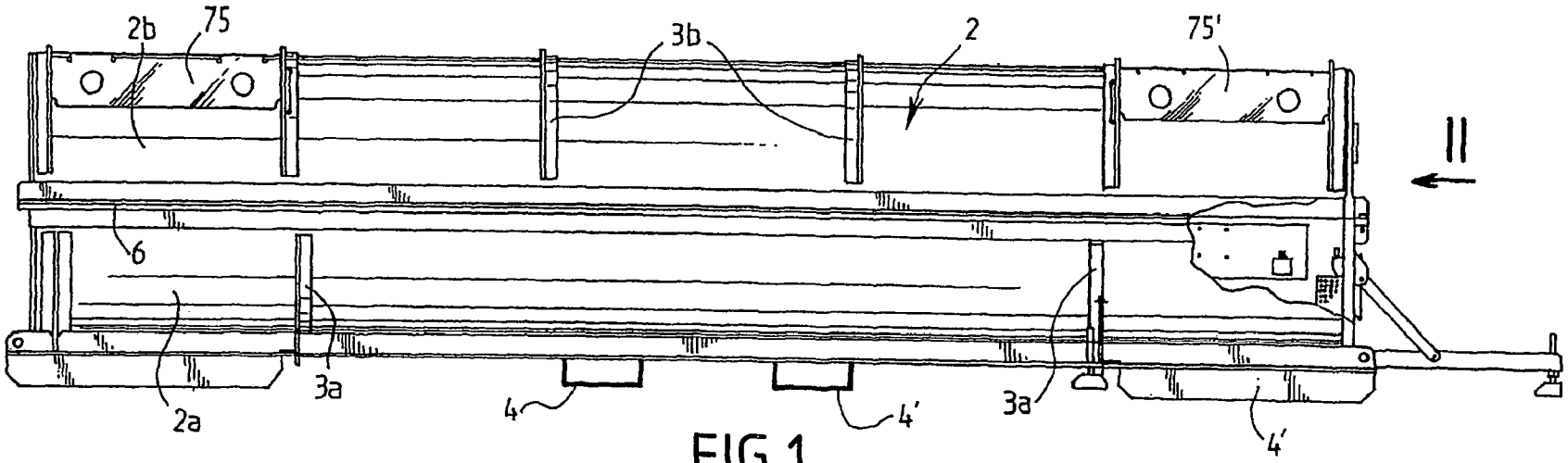
FIG. 1 is a side view of a transport container according to the invention.
Figure 2:
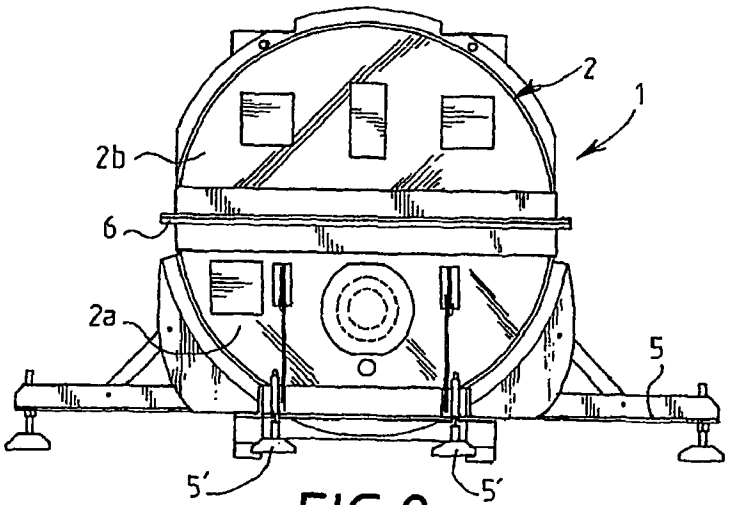
FIG. 2 is an end view of the container, in accordance with the arrow II of FIG. 1.

FIGS. 1 and 2 show a container 1 for transporting fresh fuel assemblies for a pressurized water nuclear reactor.

The transport container 1, which is intended to transport two fuel assemblies in the horizontal position, comprises an external casing 2 formed by a lower half-shell 2*a* and an upper half-shell 2*b* mounted one on top of the other in accordance with a junction plane.

Each of the half-shells 2*a* and 2*b* is produced from sheet-steel and comprises respective reinforcing bows 3*a*, 3*b* distributed along the length of the half-shell.

Sectional members 4 and 4' forming support feet for the container are also secured to the lower portion of the lower half-shell 2*a*. In addition, adjustable bearing members 5 and 5' which comprise screw jacks and which are fixedly joined to a longitudinal end portion of the container enable the inclination of the container resting on a support surface to be adjusted, about the longitudinal axis of the container and about a transverse axis, respectively.

The two half-shells 2*a* and 2*b* are mounted one on top of the other by way of peripheral end-plates constituting an upper flat bearing portion of the lower half-shell 2*a* and a flat lower bearing portion of the upper half-shell 2*b* of the container.

In the closed position of the container shown in FIGS. 1 and 2, the end-plates of the two half-shells 2*a* and 2*b* are mounted and secured one on top of the other by screws and nuts and form an assembly flange 6.

Figure 3A:
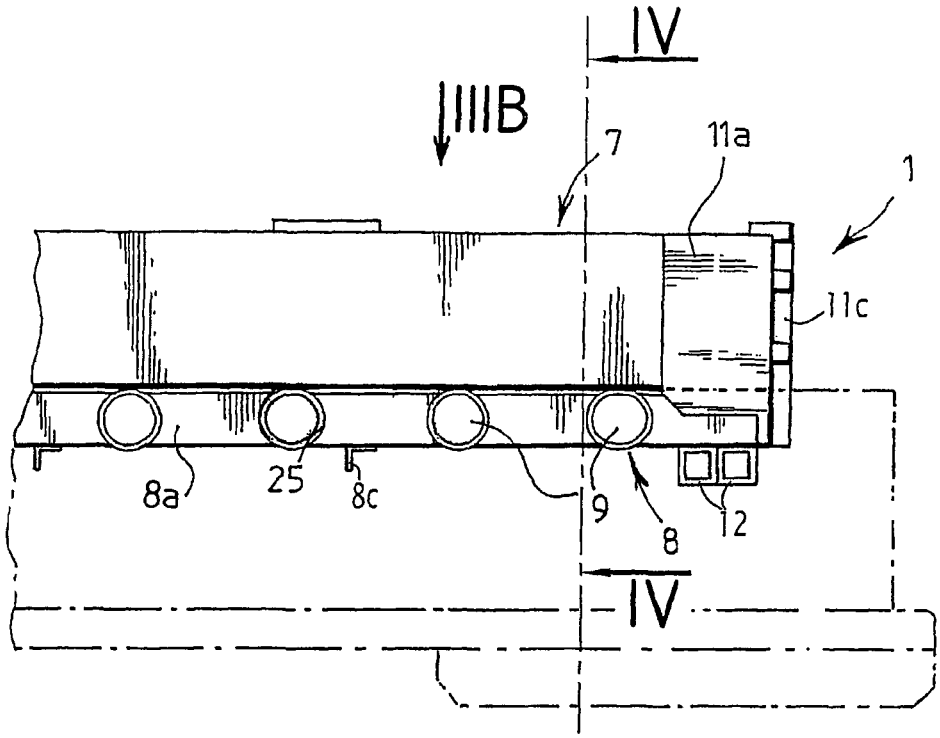
FIG. 3A is a side view of the rear portion of the internal structure of the container of FIGS. 1 and 2, the lower half-shell of the external casing being shown with a dot-dash line.
Figure 3B:
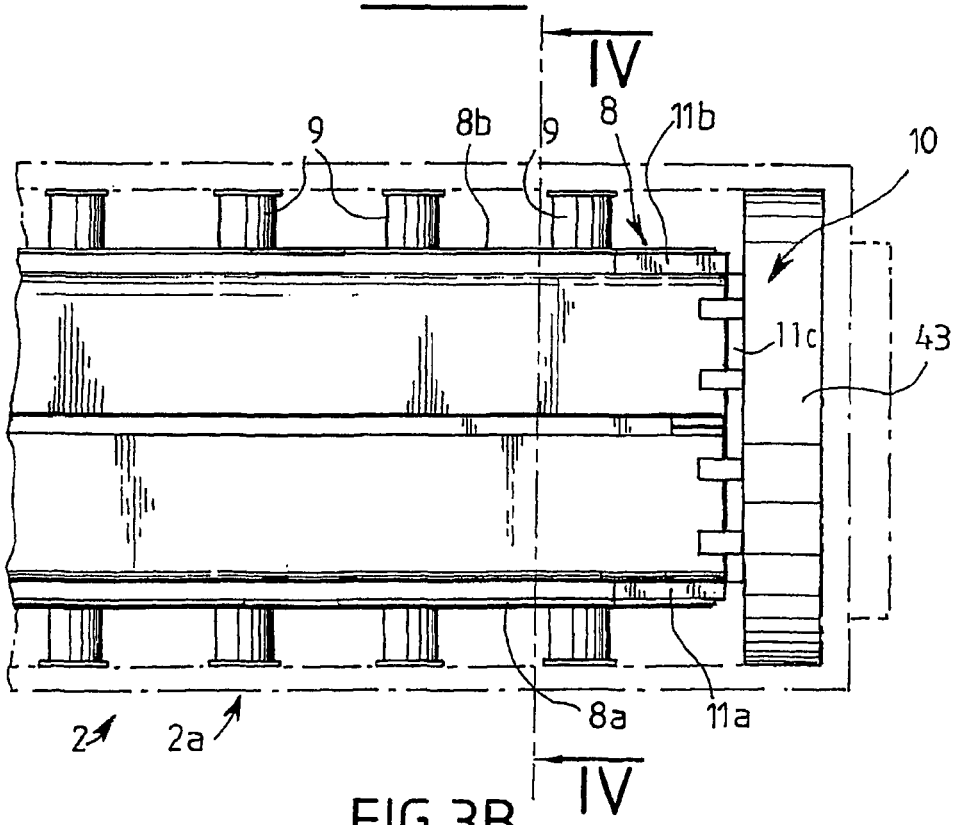
FIG. 3B is a top view of the internal structure, viewed in accordance with the arrow IIIB of FIG. 3A.

FIGS. 3A and 3B show a portion of the container in the open state, that is to say, with the upper half-shell of the casing of the container separated from the lower half-shell and removed.

In FIGS. 3A and 3B it is possible to see the internal structure of the container which is indicated in a general manner by the reference 7 and which comprises, in particular, a cradle 8 which rests on supports 9 formed by damper studs, in the lower half-shell 2*a* of the external casing 2 of the container. A second portion of the internal structure of the container is formed by an assembly 10 for receiving and supporting two fuel assemblies placed side by side in a horizontal position. The assembly 10, which rests on the cradle 8, delimits two completely closed housings for two fuel assemblies, as will be explained hereinafter.

The cradle 8 comprises two longitudinal members 8*a*, 8*b* formed by angle beams which are secured to the support studs 9 and which are maintained in parallel arrangements with a spacing corresponding to the width of the receiving assembly 10 by cross-members 8*c*. At one of its ends, the cradle comprises an assembly for stiffening and for pivot mounting, comprising two plates 11*a* and 11*b* which are parallel with each other, and two cross-members 12 formed by hollow sectional members secured below the longitudinal members of the cradle and to the plates 11*a* and 11*b*.

The pivot mounting of the assembly 10 on the lower half-shell of the container, about a horizontal axis of transverse direction, is ensured by means of the stiffening and pivot-mounting assembly comprising the plates 11*a* and 11*b*.

In addition, as will be explained hereinafter, a retaining plate 11*c* for the fuel assemblies is also mounted between the plates 11*a* and 11*b*.

As shown in FIG. 3B, in order to limit the effect of impact on the fuel assemblies, for example the effect of the container 1 falling, a buffer 43 is interposed between the longitudinal end of the internal structure 7 and the internal end wall of the external casing 2, of circular shape. The buffer 43, in the form of a disc, the cross-section of which is identical to the internal cross-section of the container casing, is formed by a disc of balsa wood surrounded by a casing of stainless sheet-steel. An identical buffer is located at the second longitudinal end of the container, between the second longitudinal end of the internal structure and the second end of the external casing.

Figure 4:
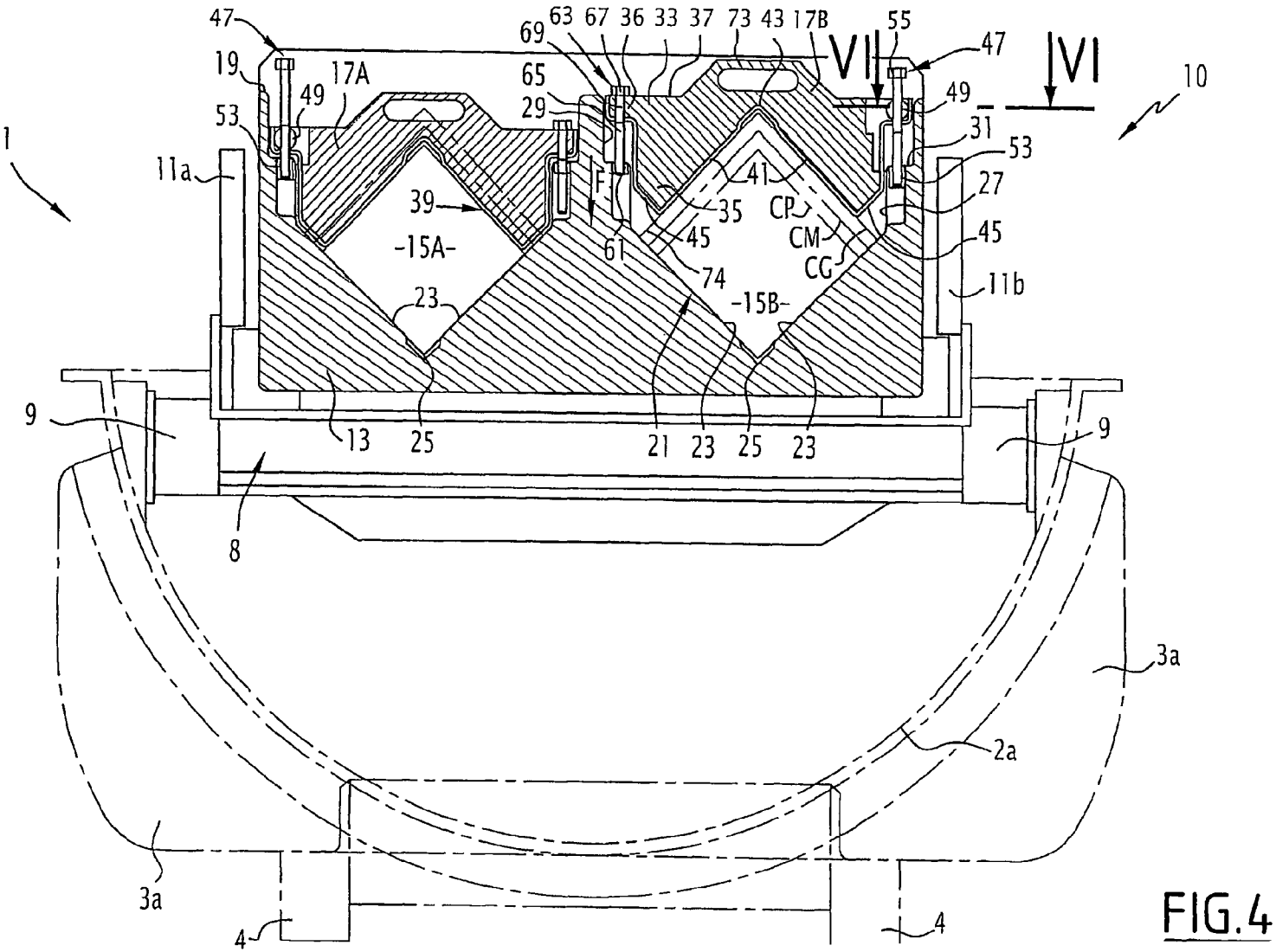
FIG. 4 is a sectional view of the internal structure of FIGS. 3A and 3B, in a transverse plane, taken in accordance with the arrows IV of FIG. 3A, showing two housings for receiving nuclear fuel assemblies, the doors of which are shown in the holding position, the spacing between the two bearing surfaces of the housing on the left being suitable for an assembly having a small cross-section and the spacing between the two bearing surfaces of the housing on the right being suitable for an assembly having a large cross-section.

As can be seen in FIG. 4, the assembly 10 comprises a parallelepipedal support 13 in which the housings 15A and 15B for receiving a nuclear fuel assembly are formed, and two doors 17A and 17B capable of closing the housings 15A and 15B. The support 13 is elongate longitudinally and has a rectangular cross-section which is constant over the entire longitudinal length of the support 13. The two housings 15A and 15B extend longitudinally, parallel with each other, and open out in an upper face 19 of the support 13.

The housings 15A and 15B are identical. Only one of them will be described below. Likewise, the doors 17A and 17B are identical, and only one of them will be described below.

The base of the housing 15B is delimited by a first V-shaped bearing surface 21, comprising a first pair of longitudinal faces 23 forming an angle of 90° between them. The first pair of faces 23, viewed in cross-section, converges towards a vertex 25, corresponding to the deepest point of the housing 15B and where the faces 23 join. The two faces 23 continue towards the top of FIG. 4, that is to say, towards the upper face 19, by way of two lower guide surfaces 27, which are parallel with each other and perpendicular to the face 19, then by way of two upper guide surfaces 29, which are also parallel with each other and perpendicular to the face 19.

The surfaces 27 have between them a transverse spacing less than that of the surfaces 29, with the result that shoulders 31 are formed between the surfaces 27 and 29.

Figure 5:
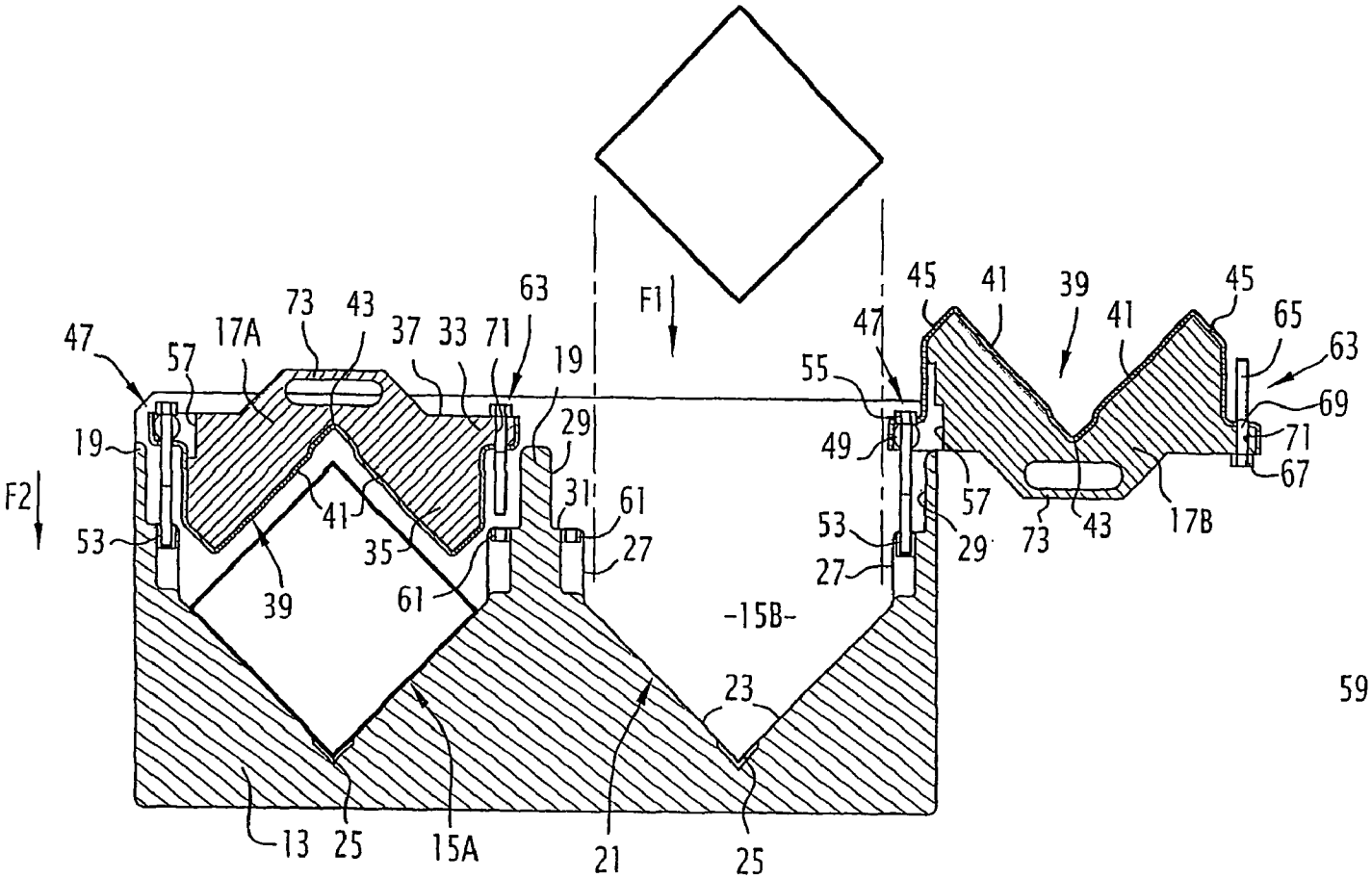
FIG. 5 is a view similar to that of FIG. 4, the door of the housing on the right being shown in the release position, the door of the housing on the left being shown in a position which is off-set to the maximum extent towards the top and which is intermediate between the holding and release positions.

The door 17B extends over the entire longitudinal length of the housing 15B. It is movable between a position, shown in FIG. 4, of holding the nuclear fuel assembly in the housing 15B, and a release position in which the assembly is free with respect to the support 13 and which is shown in FIG. 5. These positions will be described in detail hereinafter.

The door 17B comprises an upper portion 33 and a lower portion 35 of reduced width compared with the portion 33, the width corresponding to the transverse direction when the door is in the holding position. The upper portion 33 therefore comprises two lateral edges 36 projecting one on each side of the portion 35.

The respective widths of the portions 33 and 35 correspond to the transverse spacing between the upper guide surfaces 29 and the lower guide surfaces 27, respectively, and are constant along the entire housing 15B.

The upper portion 33 is delimited on the side remote from the portion 35 by a substantially flat upper surface 37. The lower portion 35 is delimited on the side remote from the portion 33 by a second longitudinal bearing surface 39 having, in a transverse plane, the shape of a W.

The second bearing surface 39 comprises at the centre a second pair of longitudinal faces 41 arranged in the shape of a V and forming an angle of 90° between them. The faces 41 converge towards a second vertex 43 where they join. The second bearing face 39 also comprises two lateral faces 45 extending the faces 41 away from the vertex 43. The faces 45 are substantially perpendicular to the faces 41.

The faces 23 of the first pair are wider than the faces 41 of the second pair, viewed in a transverse plane.

For each door 17A, 17B, the assembly 10 also comprises means for displacing the door with respect to the support 13 between its holding and release positions, these means also enabling the spacing between the first and second surfaces 23 and 39 to be adjusted when the door occupies its holding position. Only the means for displacing the door 17B will be described here, those of the door 17A being identical.

The displacement means comprise, for example, two screws 47 mounted to rotate freely on the support 13, a plurality of nuts 49 which are movable along the screws 47 and which are each provided with two shaft ends 51 (FIG. 6), the door 17B being mounted to be movable in rotation about the shaft ends 51 and being connected, in terms of translation along the screws 47, to the nuts 49.

As can be seen in FIG. 4, the screws 47 extend in a vertical direction in FIG. 4, perpendicularly to the upper face 19. They are engaged by their free ends in bearings 53 formed in the shoulder 31 of the support 13. The screws 47 are fixed in terms of translation vertically in the bearings 53 and are free to rotate in these bearings. The bearings 53 are located in the shoulder 31 furthest away from the housing 15A.

The screws 47 are distributed longitudinally along the door 17B.

The vertical length of the screws 47 is such that their heads 55 are located outside the support 13, projecting above the upper face 19.

Figure 6:
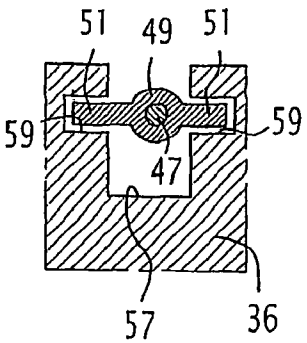
FIG. 6 is an enlarged sectional view of the means for displacing a door, taken in accordance with the arrows VI of FIG. 4.

As can be seen in FIGS. 4 to 6, the door 17B comprises, in the region of each screw 47, a recess 57 formed in the edge 36 of the upper portion 33.

The recesses 57 are formed through the entire vertical thickness of the edge 36, the screws 47 passing through the recesses 57. The nuts 49 are located in the recesses 57.

The door 17B also comprises blind holes 59 formed longitudinally in the thickness of the edge 36 and opening out in each recess 57.

As shown in FIG. 6, the shaft ends 51 are fixedly joined to the nuts 49 and extend longitudinally from the nuts 49. They are engaged in the blind holes 59 and can rotate freely in these holes.

The assembly 10 also comprises for each housing 15A, 15B a plurality of threaded orifices 61 formed in the shoulder 31 remote from the screws 47, and a plurality of screws 63 for securing the door 17A, 17B in the holding position, which screws 63 can be screwed into the orifices 61. The number of screws 63 may be, for example, from ten to fifteen. Only the means for securing the door 17B will be described here.

As shown in FIG. 4, each of the securing screws 63 comprises a threaded end portion 65, a head 67 remote from the portion 65, and a smooth portion 69 interposed between the head 67 and the threaded portion 65. The door 17B comprises a plurality of smooth holes 71 (FIG. 5) formed in the edge 36 located on the same side as the housing 15A in the holding position. The screws 63 are engaged in the smooth holes 71, the smooth portion 69 being located in the smooth hole 71, the head 67 bearing against the upper face 37 of the door 17B, and the threaded portion 65 being screwed into the threaded orifice 61 of the support. The orifices 61 and 71 and the securing screws 63 are distributed regularly along the housing 15B.

In addition, each of the doors 17A, 17B comprises two handles 73 projecting towards the top relative to the face 37. These handles 73 are located in the vicinity of the longitudinal ends of the doors.

When the door 17A, 17B is in the holding position, its upper portion 33 is engaged between the upper guide surfaces 29 and the lower portion 35 is engaged between the lower guide surfaces 27. The second bearing surface 39 faces the base of the housing 15A, 15B, and the faces 41 of the second pair are parallel with and opposite the faces 23 of the first pair. The first and second vertices 23 and 43 are then aligned vertically in FIG. 4, that is to say, in a direction perpendicular to the face 19, and the upper surface 37 is parallel with the face 19.

The release position of the door 17B is illustrated in FIG. 5. In this position, the door 17B is mounted to the maximum extent along the screws 47 and is swung towards the outside of the housing 15B about the shafts 51. The nuts 49 are in abutment with the heads 55 of the screws 47. The upper surface 37 of the door 17B extends substantially horizontally, at the level of the upper face 19, the second bearing surface 39 facing the top of FIG. 5 and away from the housing 15B. The release position of the door 17A is symmetrical with the release position of the door 17B relative to a centre longitudinal plane of the housings 15A and 15B.

The operation of the container described above will now be explained.

In order to load nuclear fuel assemblies into the container, the two half-shells 2*a* and 2*b* are first of all detached from each other by unscrewing the screws of the flange 6, and the upper half-shell 2*b* is removed. The assembly 10 is then detached from the cradle 8 and the assembly 10 is swung into a substantially vertical position about the transverse axis located at one of the ends of the cradle.

The doors 17A and 17B are then placed in the release position in order to give access to the housings 15A and 15B.

A nuclear fuel assembly can then be placed in each of the housings 15A and 15B, by a fuel assembly lifting tool, such as the winch of a travelling crane, by displacing the assembly horizontally, in accordance with the arrow F1 in FIG. 5. The fuel assemblies come to rest, by way of their lower ends, on the fuel assembly support plate 11C secured between the two plates 11A and 11B of the assembly 10.

In the case of fuel assemblies having a square cross-section, an assembly is placed in each housing 15A, 15B in such a manner that two adjacent lateral sides of this assembly rest on the faces 23 of the first bearing surface 21, as illustrated on the left in FIG. 5. The edge separating the two adjacent sides of the fuel assembly is located along the vertex 25.

Once the assemblies are in place in the housings 15A, 15B, the doors 17A, 17B are closed. For that purpose, each door 17A, 17B is caused to pivot about the shafts 51, through approximately 180°, the door then occupying an intermediate position illustrated on the left in FIG. 5. In this intermediate position, the lower portion 35 of the door is engaged in the housing, the faces 41 of the second bearing surface 39 being separated from the fuel assembly by a free space.

The screws 47 are then caused to turn in the bearings 53 by means of suitable tools in order to cause the nuts 49 to descend along the screws 47, the shaft ends 51 driving the door towards the assembly located in the housing.

When the faces 41 of the second bearing surface 39 come into contact with the nuclear fuel assembly, the translational movement of the cover 17A, 17B is interrupted. It will be noted that the second bearing surface 39 comes into direct contact with the nuclear fuel assembly. In particular, the door 17B, just like the door 17A, is free from bearing runners, such as those provided in the prior art at right-angles to each of the grids of a nuclear fuel assembly to be transported.

It will be appreciated that the translational movement is effected in a direction symbolized by the arrow F1 in FIG. 5 and passing via the vertices 25 and 43 of the two bearing surfaces 21 and 39.

This second part of the movement of the door 17A, 17B enables the spacing between the first and second bearing surfaces 21 and 39 to be adjusted in the holding position of the door, in accordance with the size of the fuel.

For, as shown in FIG. 4, for fuel having a square cross-section of large size, the translational movement of the door 17A, 17B will be interrupted earlier. The cross-section of such fuel is symbolized by the line marked CG on the right in FIG. 4. In that case, the faces 41 of the second bearing surface 39 bear against the two adjacent sides of the fuel that face the top of FIG. 4, but cover only a portion of those sides. A band 74 of those sides remains free, between the first and second surfaces 21 and 39.

For fuel having a cross-section of intermediate size, symbolized by the dot-dash line CM in FIG. 4, the translational movement of the door 17A, 17B is stopped further away than in the case of fuel having a cross-section CG. The free band 74 is reduced.

Finally, for fuel having a cross-section of small size, symbolized by the dot-dash line CP in FIG. 4, the descent movement of the door 17A, 17B is stopped even further away than for the cross-sections of size CG and CM, the door coming into contact with the faces 23 by way of the lateral faces 45 of the second bearing face. The sides of the assembly that face the top of FIG. 4 are completely covered by the faces 41 of the second bearing surface 39. There is no longer a free band 74.

In its translational movement towards the vertex 25 of the housing 15A, 15B, the upper portion 33 of the door is guided by the upper guide surfaces 29, and the lower portion 35 of the door is guided by the lower guide surfaces 27.

Once the door 17A, 17B is in its holding position, the screws 63 are screwed into the threaded orifices 61. The serpentine form, the surface state and the manufacturing tolerances of the guide surfaces 27 and 29 and of the shoulder 31, on the one hand, and of the doors 17A, 17B, on the other hand, are such that the housings 15A, 15B are well sealed and that the nuclear materials are confined in the housings 15A, 15B in the event of a serious accident which would have caused cladding bursts in the assemblies.

The assembly 10 is subsequently swung as far as the horizontal position and then comes to rest on the cradle 8 where it is secured by bolts.

After placing the upper half-shell back on the lower half-shell of the casing 2 and securing the two half-shells by screws and nuts, it is possible to handle and transport the container, for example, by lifting the container by means of the lifting feet 75 and 75' secured to the upper half-shell of the external casing, as is shown in FIG. 1.

The procedure for unloading the nuclear fuel assemblies is the reverse of the procedure for loading these assemblies into the container. It will not be explained in detail here.

The transport container described above can be used for fresh or irradiated nuclear fuel assemblies, regardless of the nuclear fuel $UO_2$,$PuO_2$ . . . . It can also be used to transport equipment having a space requirement similar to that of a nuclear fuel assembly, for example rod boxes, quiver-like supports, or skeletons of nuclear fuel assemblies.

The container described above has multiple advantages.

It is possible in the same container, with the same internal structure, to transport nuclear fuel assemblies of different sizes. This result is achieved owing to the fact that it is possible to adjust the spacing between the first and second bearing surfaces 21 and 39 by displacing the doors 17A, 17B along the screws 47.

The adjustment described above is also effected using simple and economical means: the screws 47 mounted in the bearings 53, and the nuts 49 provided with shafts 51 engaged in the blind holes 59 of the door.

It is possible in the same container, with the same internal structure, to transport nuclear fuel assemblies having different grid positions. This result is achieved owing to the fact that the bearing surfaces 21 and 39 are smooth and the doors 17A, 17B do not have movable runners which are to rest on the grids of a transported nuclear fuel assembly. This feature is also advantageous with regard to the cleaning and decontamination of the receiving housings 15A and 15B and the doors 17A and 17B of the container, the surfaces 21 and 39 of which are smooth and may be free from retention zones.

This feature is also advantageous with respect to the increase in mass associated with the absence of runners in that it enables more assemblies to be transported for the same external space requirement.

The operation of the container is particularly simple owing to the fact that it comprises only a small number of screws 47 enabling the position of the door to be adjusted, and a small number of securing screws 63.

The container described above may have multiple variants.

Thus, the means for displacing the doors 17A and 17B on the support 13 may have structures other than that described above. By way of example, they may be in the form of connecting rods arranged to form an arm of the pantograph type. Such arms are known from the prior art and therefore will not be described in detail here. They make it possible to obtain a movement of the door, first of all of rotation and then of translation, to pass from its release position to its holding position, like the screw and nut displacement means described above.

More generally, these displacement means do not necessarily ensure a movement of translation and then of rotation.

It is thus possible to provide that each door will pass from its holding position to its release position by a simple translational movement along the screws 47 perpendicularly to the upper face 19 of the support 13, without a 180° rotation as in the embodiment described above. In that case, the release position corresponds substantially to the position of the door illustrated on the left in FIG. 5. The introduction of the nuclear fuel assemblies into the housings is then effected by a longitudinal movement, by means of a crane. The withdrawal of the assemblies from the housings is effected in the same manner.

In a variant, it is also possible to provide that the door is dismountable, in which case the screws 47 can be replaced by securing screws of the same type as the screws 63. In order to load and unload the assemblies into and from the housings, all of the securing screws are then unscrewed and the doors 17A, 17B are subsequently removed completely, for example by means of a travelling crane.

Protective means may be located around the nuclear fuel assemblies, inside the support 13 and/or the doors 17A, 17B. These protective means may be of different types. They may be of the mechanical type in order to stiffen the internal equipment of the container and to protect the fuel assemblies in the event of the container falling or in the event of impact. These protective means may also be of the neutron type and may absorb the neutrons emitted by the nuclear fuel assemblies. The protective means may also be of the thermal type in order to prevent the heat generated by the fuel assembly from being conducted through the support or the door. The protective means may also be of the biological type and may absorb the ionizing radiation emitted by the nuclear fuel assemblies, for example gamma radiation. It is even possible that these protective means may be sufficient to transport a nuclear fuel assembly without an external casing 2 being necessary.

The container described above is suitable for transporting nuclear fuel assemblies for a BWR reactor (boiling water reactor) or a PWR reactor (pressurized water reactor). These assemblies may be of the type 17×17, 10×10, 18×18, or of any other type. It will be recalled that these numbers characterize the square network in accordance with which the fuel rods are arranged. Thus, a 17×17 assembly has a network of seventeen rows of seventeen rods or accessories.

The container can also be adapted to transport nuclear fuel assemblies, the cross-section of which is not square but, for example, rectangular or hexagonal.

In such cases, the adjustment of the position of the door relative to the support 13 is not necessarily effected by a vertical translation as described above and represented by the vertical arrow F1 in FIG. 5. Thus, in case of rectangular assemblies, this translation will be effected in a direction passing via the vertices 25 and 43 of the longitudinal bearing surfaces 21 and 39.

In the case of a hexagonal nuclear fuel assembly, it is provided, for example, that the faces 23 of the first bearing surface 21 form between them an angle of approximately 60°.

Likewise, it is provided, for example, that the faces 41 of the second bearing surface 39 form between them an angle of 60°. The assembly is arranged in the housing in such a manner that a first side of the hexagon is in contact with one of the faces 23, and a second side of the hexagon is in contact with the other face 23. A third side of the hexagon, connecting the first and second sides, extends from one face 23 to the other, opposite the vertex 25. This third side is not placed against the bearing surface 21. In the same manner, two other sides of the hexagon rest against the faces 41 of the second bearing surface 39, one side of the hexagon extending between these two faces 41, opposite the vertex 43.

In the same manner, the internal structure of the container can be adapted to transport nuclear fuel assemblies having an octagonal or triangular cross-section or any other polygonal cross-section.

Figure 7A:
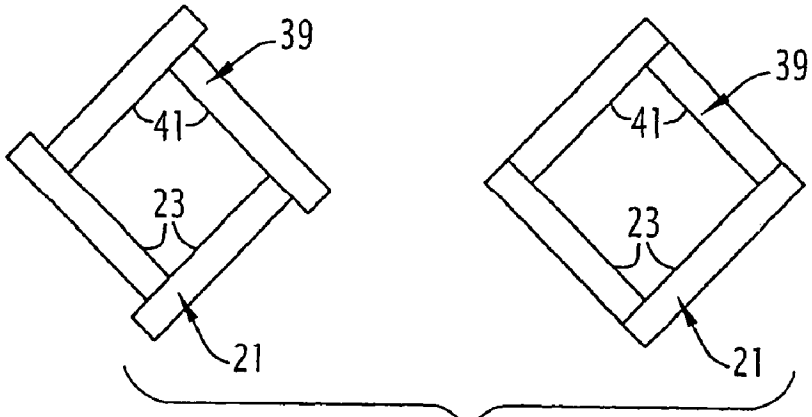
FIGS. 7A and 7B are simplified schematic representations in cross-section of the bearing surfaces of the internal structure of the container, for two variants of the invention.

In a variant, it is possible to provide that the two pairs of faces 23 and 41 of the first and second bearing surfaces 21 and 39 form a continuous square, of variable size depending on the cross-section of the assembly to be transported, as illustrated in FIG. 7A. In that case, the means for adjusting the spacing between the first and second surfaces 21 and 39 may comprise means for displacing in a co-ordinated manner the four faces 23 and 41 along each other, in order to vary the size of the square. The faces 23 and 41 remain perpendicular to each other in the course of this movement.

Figure 7B:
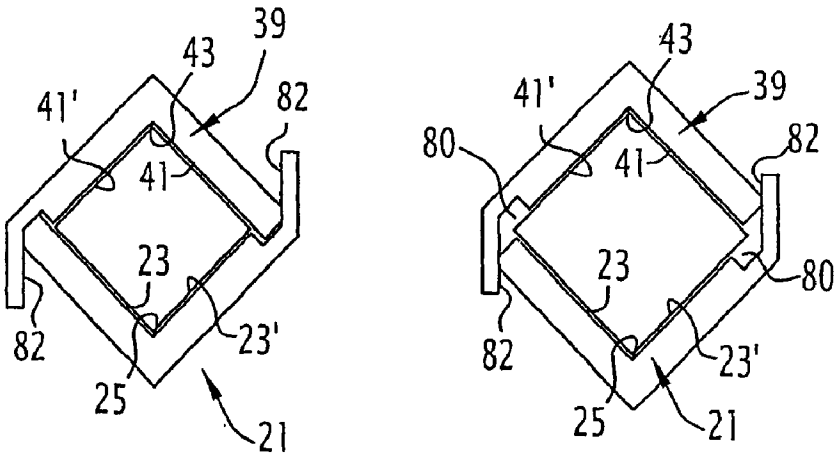

According to another variant, illustrated in FIG. 7B, each of the first and second bearing surfaces 21 and 39 comprises a large face 23, 41 and a small face 23', 41' which is narrower than in the large face in a transverse plane. Each of the first and second surfaces 21, 39 also comprises an undercut 80 bordering the small face and delimited in part by a guide surface 82. The guide surfaces 82 extend substantially parallel with the diagonal passing via the vertices 25 and 43, that is to say, vertically in FIG. 7B. As shown in FIG. 7B, the two large faces 23, 41 are parallel and opposite, and the two small faces 23', 41' are parallel and opposite. The two faces of the same bearing surface are typically perpendicular to each other. As can be seen on the right in FIG. 7B, for a nuclear fuel assembly having a large cross-section, the two opposite sides of this assembly resting on the large faces 23 and 41 are completely covered by those faces. On the other hand, the two opposite sides resting on the small faces 23' and 41' are only partially covered by those faces. It can be seen on the left in FIG. 7B that, for nuclear fuel assemblies having a small cross-section, the four sides of these assemblies are completely covered by the faces 23, 23', 41, 41', the free edges of the large faces 23 and 41 engaging in the undercuts 80 of the opposite surface.

The surfaces 82 enable the relative displacement of the first and second bearing surfaces 21 and 39 to be guided. Furthermore, they form baffles enabling sealing to be improved.

Finally, the bearing surfaces 21 and 39 are delimited by two identical members which are fitted together head to tail, which enables the production costs to be reduced.

Preferably, the faces of the first surface 21 form between them an angle substantially equal to the angle which the faces of the second surface 39 form between them. This angle is from 60° to 135°, depending on the geometry of the nuclear fuel assemblies to be transported.

More generally, the container 1 according to the invention can receive a number of nuclear fuel assemblies other than two. Thus, it may be configured to receive a single nuclear fuel assembly, or in some variants a much higher number, for example six or eight.

The container 1 may also comprise, in addition to the first and second longitudinal bearing surfaces, a third longitudinal bearing surface.

Each of these longitudinal bearing surfaces may comprise, as in the examples described above, two longitudinal faces, but the number of faces may also be different, for example a single longitudinal face may be envisaged, and three longitudinal faces may be envisaged.

Thus, for nuclear fuel assemblies having a hexagonal cross-section, it is possible to provide three longitudinal bearing surfaces each comprising a single bearing face, these faces being inclined relative to each other by 120° when they rest against an assembly.

Still for the same type of assembly, it is possible in another variant to provide a first surface comprising three faces inclined relative to each other by 120° and intended to rest on consecutive faces of a nuclear fuel assembly. The second surface may then comprise a single bearing face.

When the same surface comprises several longitudinal faces, the latter do not necessarily intersect at a vertex as described above.

Likewise, in the examples described above, the longitudinal bearing surfaces rest directly on the nuclear fuel assemblies, without using movable holding runners.

However, it is also possible to use such runners or other means to ensure contact between the longitudinal bearing surfaces and a transported nuclear fuel assembly.

The invention described above can be readily implemented simply by modifying existing packages.

What is claimed is:

1. A transport container for a nuclear fuel assembly of elongate shape in a longitudinal direction, the container comprising:

a support having at least a first longitudinal bearing surface delimiting a longitudinal housing for receiving a nuclear fuel assembly;

a door having a second longitudinal bearing surface, the second longitudinal bearing surface including a pair of adjacent faces meeting at a vertex to form an angle, the door being movable between a holding position holding the nuclear fuel assembly between the first and second longitudinal bearing surfaces and a release position in which the nuclear fuel assembly is not held between the first and second longitudinal bearing surfaces; and an adjuster adjusting a transverse spacing between the first and second longitudinal bearing surfaces when the door is in the holding position.

2. The container as recited in claim 1, wherein the first longitudinal bearing surface comprises a first pair of adjacent longitudinal faces, and the second longitudinal bearing surface comprises a second pair of adjacent longitudinal faces, each of the second pair of adjacent longitudinal faces parallel with and opposite a corresponding one of the longitudinal faces of the first pair of adjacent longitudinal faces when the door is in the holding position.

3. The container as recited in claim 2 wherein the first and second pairs of adjacent longitudinal faces converge towards first and second vertices, respectively, and the adjuster comprises a means for adjusting a position of the door with respect to the support by translation of the door in a transverse adjusting direction when the door is in the holding position.

4. The container as recited in claim 3 wherein the support comprises parallel longitudinal surfaces for guiding the translation of the door in the adjusting direction.

5. The container as recited in claim 3 wherein the container comprises means for displacing the door with respect to the support between the holding position and the release position by translation in the direction of adjustment and then rotation about at least one longitudinal shaft coupled to the support and to the door.

6. The container as recited in claim 2 wherein the first pair of adjacent longitudinal faces form an angle equal to an angle formed by the second pair of adjacent longitudinal faces, the angle being from 60° to 135°.

7. The container as recited in claim 1 wherein the second longitudinal bearing surface is free from movable runners for resting on a nuclear fuel assembly.

8. The container as recited in claim 1 for transporting a nuclear fuel assembly.

9. The container as recited in claim 8 wherein the container is used with the same support and the same door to transport nuclear fuel assemblies of at least two different types.

10. The container as recited in claim 2 wherein the second pair of adjacent longitudinal faces connect with each other at a vertex to form an angle.

11. The container as recited in claim 1 wherein the angle is a right angle.

12. The container as recited in claim 1 wherein the first longitudinal bearing surface includes a further pair of adjacent faces meeting at a further vertex to form a further angle.

13. A transport container for a nuclear fuel assembly of elongate shape in a longitudinal direction, the container comprising:

a support having at least a first longitudinal bearing surface delimiting a longitudinal housing for receiving a nuclear fuel assembly;

a door extending over an entire longitudinal length of the housing, the door having a second longitudinal bearing surface, the door being movable between a holding position holding the nuclear fuel assembly between the first and second longitudinal bearing surfaces and a release position in which the nuclear fuel assembly is not held between the first and second longitudinal bearing surfaces; and an adjuster adjusting a transverse spacing between the first and second longitudinal bearing surfaces when the door is in the holding position wherein the second longitudinal bearing surface is free from movable runners for resting on a nuclear fuel assembly.

14. The container as recited in claim 1 wherein the adjuster includes screws rotatably mounted to nuts.

15. The container as recited in claim 14 wherein the nuts are connected to the door and the screws are rotatable with respect to the support via bearings connected to the support.

16. The container as recited in claim 1 wherein the adjuster moves the door translationally so that the second longitudinal surface moves translationally with respect to the first longitudinal surface.

17. The container as recited in claim 13 wherein the second longitudinal bearing surface is capable of resting directly on the nuclear fuel assembly.

18. A transport container for a nuclear fuel assembly of elongate shape in a longitudinal direction, the container comprising:

a support having at least a first longitudinal bearing surface delimiting a longitudinal housing for receiving a nuclear fuel assembly;

a door extending over an entire longitudinal length of the housing, the door having a second longitudinal bearing surface, the door being movable between a holding position holding the nuclear fuel assembly between the first and second longitudinal bearing surfaces and a release position in which the nuclear fuel assembly is not held between the first and second longitudinal bearing surfaces; and an adjuster adjusting a transverse spacing between the first and second longitudinal bearing surfaces when the door is in the holding position;

wherein the first longitudinal bearing surface comprises a first pair of adjacent longitudinal faces, and the second longitudinal bearing surface comprises a second pair of adjacent longitudinal faces, each of the second pair of adjacent longitudinal faces parallel with and opposite a corresponding one of the longitudinal faces of the first pair of adjacent longitudinal faces as the adjuster adjusts a transverse spacing between the first and second longitudinal bearing surfaces when the door is in the holding position;

wherein the second pair of adjacent longitudinal faces connect with each other at a vertex to form an angle.

19. The transport container recited in claim 1 wherein the support includes a bottom surface and the first longitudinal bearing surface includes a pair of support faces angled with respect to each other in a V-shape, the support faces extending away from the bottom surface.

20. The transport container recited in claim 19 wherein the first longitudinal bearing surface and the second longitudinal bearing surface define a volume in the holding position, the adjuster being configured to move the door toward and away from the bottom surface in the holding position such that the volume increases and decreases and the vertex of the second longitudinal bearing surface moves toward the first longitudinal bearing surface.

* * * * *